United States Patent [19]

Svoboda et al.

[11] 4,194,758

[45] Mar. 25, 1980

[54] BRAKE MECHANISM WHICH CAN BE MOUNTED ON A SKI

[75] Inventors: Josef Svoboda, Schwechat; Erwin Weigl, Brunn; Erwin Krob, Vienna; Karl Stritzl, Vienna; Jaroslav Knotek, Vienna, all of Austria

[73] Assignee: TMC Corporation, Barr, Switzerland

[21] Appl. No.: 900,296

[22] Filed: Apr. 26, 1978

[30] Foreign Application Priority Data

Apr. 27, 1977 [AT] Austria ..... 2937/77

[51] Int. Cl.[2] ..... A63C 7/10

[52] U.S. Cl. ..... 280/605

[58] Field of Search ..... 280/605, 604, 633, 636

[56] References Cited

U.S. PATENT DOCUMENTS

| | | | |
|---|---|---|---|
| 4,078,824 | 3/1978 | Riedel | 280/605 |
| 4,101,145 | 7/1978 | Korger | 280/605 |
| 4,116,461 | 9/1978 | Krob et al. | 280/605 |

FOREIGN PATENT DOCUMENTS

| | | | |
|---|---|---|---|
| 2436155 | 2/1976 | Fed. Rep. of Germany | 280/605 |
| 2527925 | 9/1976 | Fed. Rep. of Germany | 280/605 |
| 2,606,988 | 9/1976 | Fed. Rep. of Germany | 280/605 |
| 2517829 | 11/1976 | Fed. Rep. of Germany | 280/605 |
| 2526909 | 12/1976 | Fed. Rep. of Germany | 280/605 |
| 68353 | 10/1944 | Norway | 280/605 |

*Primary Examiner*—David M. Mitchell

*Attorney, Agent, or Firm*—Blanchard, Flynn, Thiel, Boutell & Tanis

[57] ABSTRACT

A ski brake pivotally secured to a base plate which in turn is secured to the upper surface of a ski. The ski brake is composed of a brake member having a pair of braking arms and a pair of holding arms. The holding arms are interconnected via a slide piece, on the one hand, or both a slide piece and a crossbar on the other hand. The holding arms are prespring-tensioned into a position diverging away from one another with the slide piece being slidably disposed on the holding arms. The slide piece has a pair of openings therein which receive the holding arms therethrough. Thus, as the slide piece slides along the holding arms, the spacing between the holding arms will be varied in accordance with the position of the slide piece thereon. The slide piece can, if desired, be pivotally secured to the holding plate and the pivot axis therefor located on one side of the pivotal support for the brake member. The member to which the slide piece is attached and which renders it pivotally secured to the mounting plate can be appropriately torqued to generate the erecting force for the ski brake.

9 Claims, 17 Drawing Figures

BRAKE MECHANISM WHICH CAN BE MOUNTED ON A SKI

CROSS REFERENCE TO RELATED APPLICATION

This application is related to United States Patent Application Ser. No. 900,303, filed Apr. 26, 1978.

FIELD OF THE INVENTION

The invention relates to a brake mechanism which can be mounted on a ski comprising braking arms, which are arranged on both sides of the ski and are supported swingably on said ski, and which braking arms are connected to holding arms, which can be operated directly or indirectly from the ski boot, and can be swung and moved toward and away from each other by said holding arms from their braking position against spring force into their retracted position.

BACKGROUND OF THE INVENTION

It has been found to be disadvantageous in ski brakes if the braking arms, in the pulled-in position or in the retracted position, project laterally too far over the edge of the ski. On the other hand, it is important that the braking arms have a certain width in order to find sufficient resistance also in powdery snow.

The disadvantage of too much lateral projection of the braking arms beyond the edge of the skis causes the skis to be no longer able to be guided very closely to one another and, for example in the case of deep snow, the braking arms will hinder travel of the ski when in the retracted position. Thus ski brakes have become known which consist substantially of a U-shaped bent wire, the legs of which are bent twice in the center of the length thereof and are pivotally supported at said bent area on the upper side of the ski, so that the upper portion of the legs function as the operating arms and the free ends of the legs as the braking arms. The erecting power is achieved by a torsion of the bent part in these brakes. In order to move the braking arms toward one another in their retracted position, an erecting mechanism is associated with the upper part of the U-shaped wire. This causes an inward pull of the wire in the area of the bent section and thus a movement of the braking arms toward one another. It is particularly disadvantageous in such brakes that the great force which is needed for erecting the brake to the braking position very strongly stresses the erecting mechanism and thus results in a very quick wear of the same. Also working of the wire or bending of the wire in the area of the bent sections effects a strong wear of the bearing portions. These circumstances can result, only after a short operating time, in a further reduction of the actually already small pulling-in capability.

Ski brakes of a different construction, as for example braking members which are pivotal about axes which extend in the longitudinal direction of the ski and which braking members rest in the retracted position on the upper side of the ski and are swung in the braking position next to the running surface of the ski, in turn have the disadvantage that they are not automatically swung into the retracted position during insertion of the boot into the binding.

Therefore the basic purpose of the invention is to provide a brake mechanism for skis, which avoids the above-listed disadvantages and assures a movement of the braking arms toward one another in the retracted position.

The invention provides that the holding arms have at least one area which is sloped or curved relative to one another and are guided in or on a slide piece, for example a bar or the like, which, depending on the path of swing of the holding arms, is movably controlled along the holding arms and determines the spacing between the holding arms. As a result, guiding of the braking arms together in the retracted position is assured. The braking arms are preferably pulled in along their swivel axis. It can hereby be advantageous, if the slide piece is elastically prespring-tensioned into the braking position.

A preferred exemplary embodiment is distinguished by the slide piece or the like being guided on a slide of a holding plate. In order to be able to adjust the braking arms to the respective width of the ski, it is preferable, if the width of the slide piece or the like can be adjusted.

In a preferred exemplary embodiment, the ends of the holding arms are connected through a weblike surface or are designed in one piece and are elastically prespring-tensioned to or from one another. Already through this it is possible to achieve an automatic swinging out of the braking arms into the braking position, or increasing the erecting power of another spring.

BRIEF DESCRIPTION OF THE DRAWINGS

The invention will be discussed more in detail hereinbelow with reference to the exemplary embodiments and with reference to the figures in the drawings, which embodiments are not to be limiting.

The drawings schematically illustrate the parts of brake mechanism for skis, which parts are important for the invention.

DETAILED DESCRIPTION

Figure 1:
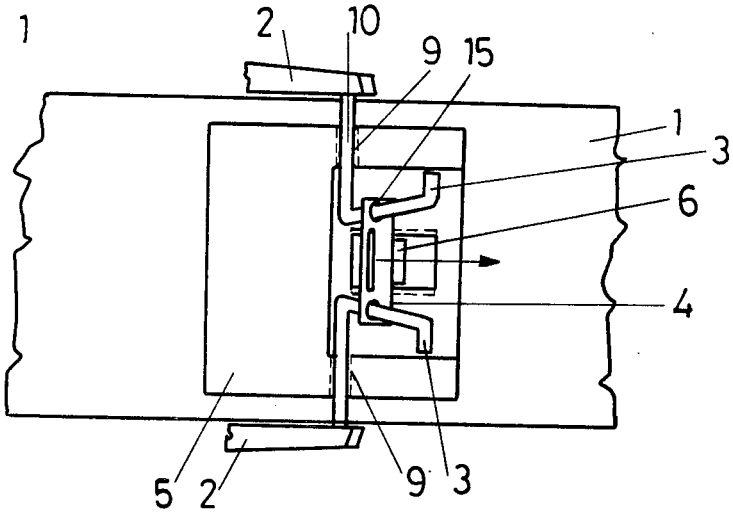
FIG. 1 is a top view of an exemplary embodiment.
Figure 2:
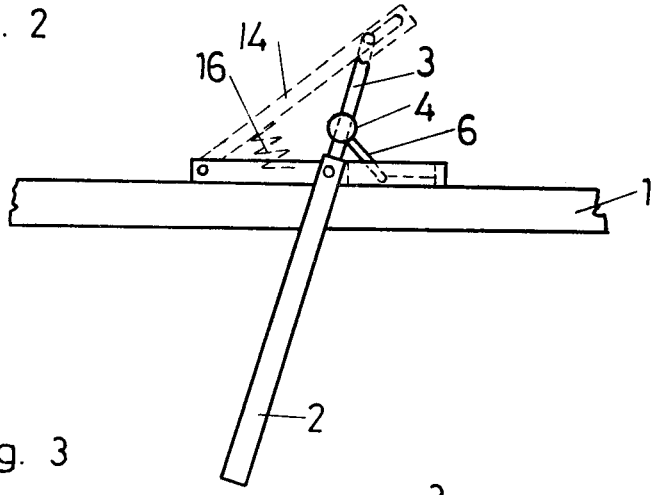
FIG. 2 is a side view of FIG. 1.

In the exemplary embodiment according to FIGS. 1 and 2, a base plate 5 is mounted on the ski, for example by not illustrated screws. The base plate 5 has bearing portions 9 receiving the bearing shafts 10 formed in the two braking arms 2. The bearing shafts 10 in turn are fixedly connected to and rotatable with the holding arms 3 or are constructed in one piece therewith. The holding arms 3 are not parallel to each other in the relaxed state but extend inclined to one another at an acute angle and have at their free ends remote from the shafts 10 a greater spacing than at the inner ends of the shafts. Furthermore, a slide piece 4 extends between and encircles the holding arms to maintain a predetermined spaced relationship between the holding arms. The slide piece 4 is constructed as a cylindrical member, which has at its end zones openings 15 extending diametrically therethrough and which are generally of a double-conical cross section. The holding arms 3 extend through the openings 15. A slide 6 is mounted on the base plate 5 and extends through the slide piece 4 and moves relative thereto in relation to the path of swing of the holding arms 3. Through this movement of the slide piece 4, the free ends of the braking arms 2 are, during a pivoting thereof up into the retracted position, drawn together by stepping down with a ski boot onto the holding arms 3. This results in the braking arms, in the retracted position, being either wholly retracted inwardly of the lateral edges of the ski 1 or to a permissible degree partially projecting laterally outwardly of the lateral edges of the ski 1.

In order to control the desired amount of lateral movement in or out of the braking arms, the holding arms 3 can be formed as desired, for example, it is possible to influence through a curved design of the holding arms the actual moment time during a swing of the brake arms of the movement in or out of the braking arms.

Figure 3:
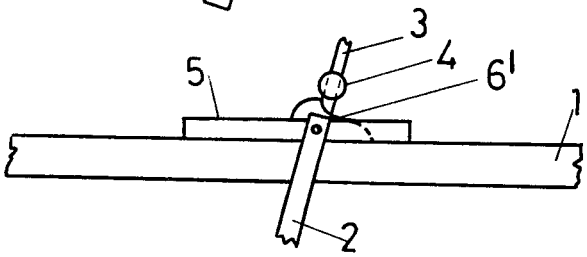
FIG. 3 is a modification of this exemplary embodiment.

FIG. 3 illustrates a further embodiment for controlling the degree of lateral movement of the braking arms toward each other in relation to the path of swing thereof between the braking position and the retracted position; the slide 6' is thereby preferably designed as a curved camlike surface. The erecting power causing the holding arms to extend upwardly relative to the upper surface of the ski can be produced in any desired manner in the illustrated exemplary embodiments. For example, it is possible to guide the holding arms 3 in a stepping plate 14, which is shown in broken lines in FIG. 2 and which is biased by a spring 16 into an upright position whereat the braking arms are in the braking position.

Figure 4:
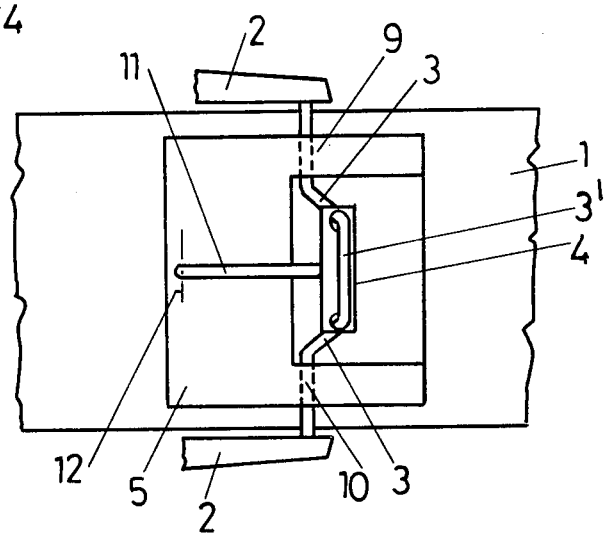
FIG. 4 is a top view of a second exemplary embodiment in the braking position.
Figure 5:
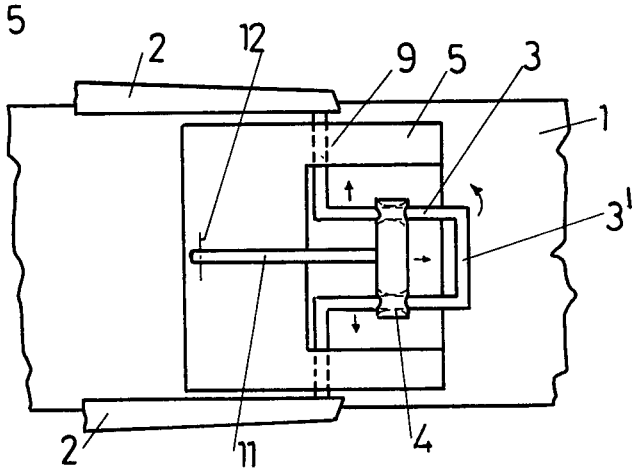
FIG. 5 illustrates the ski brake of FIG. 4 in the retracted position.
Figure 6:
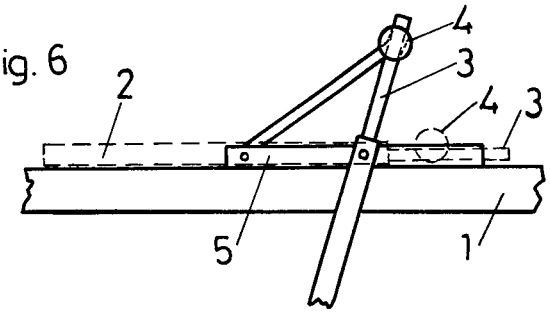
FIG. 6 is a side view of the ski brake of FIG. 4 in the braking position.
Figure 7:
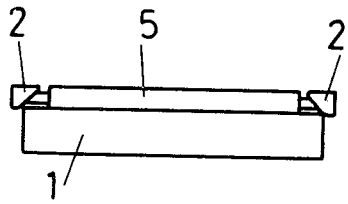
FIG. 7 is a front view of the ski brake of FIG. 4 in the retracted position.

A further exemplary embodiment is illustrated in FIGS. 4 to 7, wherein the holding arms 3 are connected together at their free ends by a crossbar 3'. Both the bearing shafts 10 of the braking arms 2 and also the holding arms 3 and the crossbar 3' are preferably manufactured in one piece and of spring wire. As is shown in FIG. 4, the two holding arms 3 are elastically prespring-tensioned to a position wherein they diverge away from the crossbar 3'. The slide piece 4 which encircles the holding arms 3 is pivotally connected through a lever 11 to the base plate 5. The axis of rotation 12 of the pivotal support is positioned in front of the bearing portions 9 of the bearing shafts 10 of the braking arms 2. If the braking arms 2 are moved into their retracted position by stepping down on the holding arms 3 with the sole of a ski boot, the bar 4 will slide along the holding arms 3 and, as a result, pulls the braking arms 2 inwardly toward each other over the upper surface of the ski. Such a construction has the advantage that through the prespring-tensioning of the holding arms 3, the braking arms 2 will be both driven laterally outwardly and also moved to the braking position. However, it is also posible in this exemplary embodiment to increase the erecting power through other means. In order to facilitate the movement of the braking arms 2 laterally outwardly, it is preferable, if these, as is shown in FIG. 7, are approximately triangularly profiled. This prevents a possible snagging on the upper side of the ski.

Figure 8:
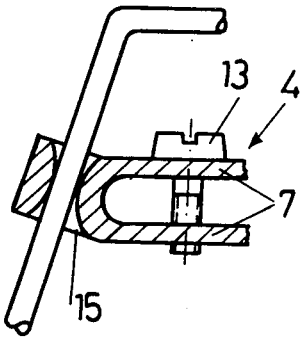
FIG. 8 is a fregment of an inventive ski brake having a bar which can be adjusted in width.
Figure 9:
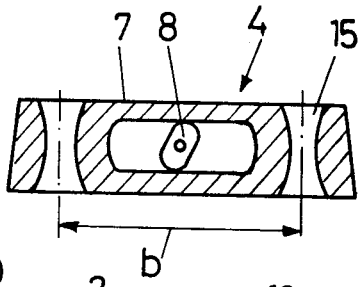
FIG. 9 illustrates a modification of the bar portion of FIG. 8.

FIGS. 8 and 9 illustrate slide pieces 4 which can be adjusted in width, which slide pieces permit an adjustment of the braking arms to the respective width of the ski.

In the exemplary embodiment which is illustrated in FIG. 8, the slide piece 4 is divided into two weblike members or bars 7, which can be moved toward and away from one another by means of a screw 13. As a result, the relative length of the weblike members 7 and thus the width b of the slide piece 4 is changed, so that the initial lateral position of the braking arms can be adjusted. In the exemplary embodiment, which is illustrated in FIG. 9, the function of the screw is taken over by an eccentric 8 which bends the weblike members 7 outwardly. In this exemplary embodiment, the weblike members 7 are made preferably of an elastic material. To assure a satisfactory movement of the slide piece 4 along the holding arms 3, the openings 15 are designed approximately in the shape of a hyperboloid of revolution and the lateral spacing between their axes determines approximately the width b of the slide piece 4.

Figure 10:
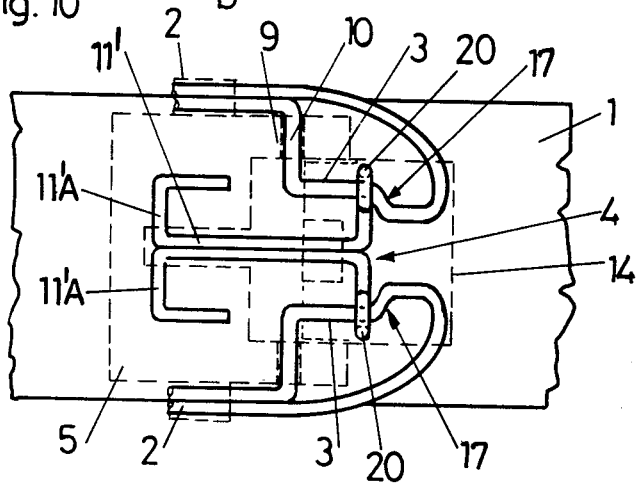
FIG. 10 is a top view of a further exemplary embodiment of the inventive ski brake in the retracted position.
Figure 11A:
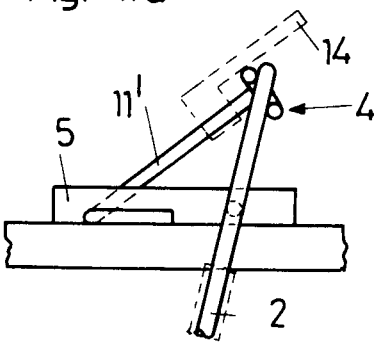
FIG. 11*a* is a side view of the ski brake of FIG. 10 in the braking position.

FIGS. 10 and 11*a* illustrate a further exemplary embodiment of the invention wherein the slide piece 4 has a torsional portion thereon and which is pivotally connected to the base plate 5. The torsional force is generated when the slide piece is pivoted to the retracted position of the brake arms and constitutes the erecting power for effecting a movement of the braking arms 2 to the braking position. The two braking arms 2 are hinged through bearing shafts 10 in the bearing portions 9 of an indicated base plate 5. The holding arms 3 have a double bend 17, which causes the braking arms 2 to be moved inwardly only shortly before reaching the retracted position. The slide piece portion 4 which controls the spacing between the two holding arms 3 is prespring-tensioned in the direction of the braking position. This is realized in the present exemplary embodiment by the slide piece portion 4 being connected to the base plate 5 through a control lever 11', which control lever is designed as a spring wire. The control lever 11' has in the braking position U-shaped ends 11'A which are bent into the plane of the upper surface of the ski and which ends are fixed in and positioned beneath the base plate 5. Both the control lever 11' and also the slide piece portion 4 thereof are designed in one piece of spring wire and the slide piece 4 exactly guides the holding arms 3 in eyelets 20 formed therein. Furthermore, a stepping plate 14 can be mounted on the slide piece portion 4 or on the control lever 11'.

Figure 11B:
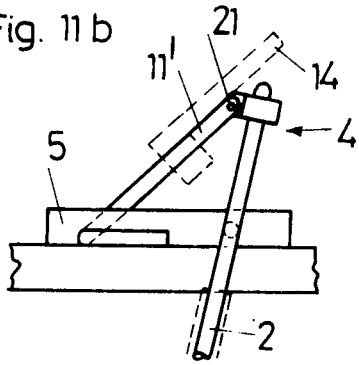
FIG. 11*b* is a modification of FIG. 11*a;*.

In the modified embodiment illustrated in FIG. 11*b*, the slide piece portion 4 and the control lever 11' are designed as separate structural elements and are connected through a pivot joint 21. As a result, the thus needed, relatively large play of the holding arms in the guide eyelets 20 can be reduced.

Figure 12:
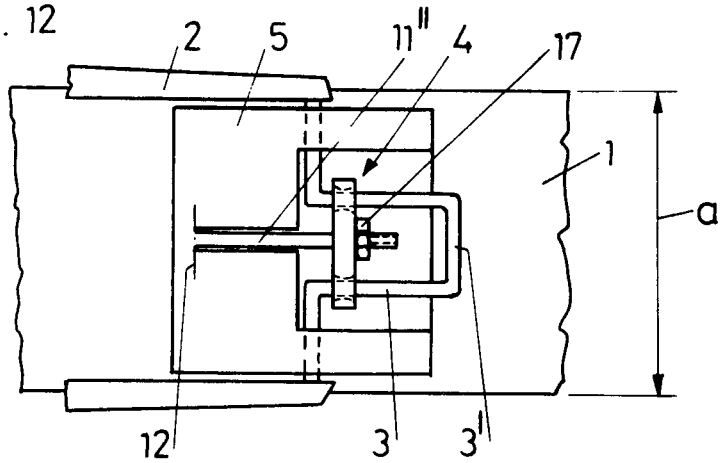
FIGS. 12 to 16 illustrate further modifications of an inventive ski brake.
Figure 13:
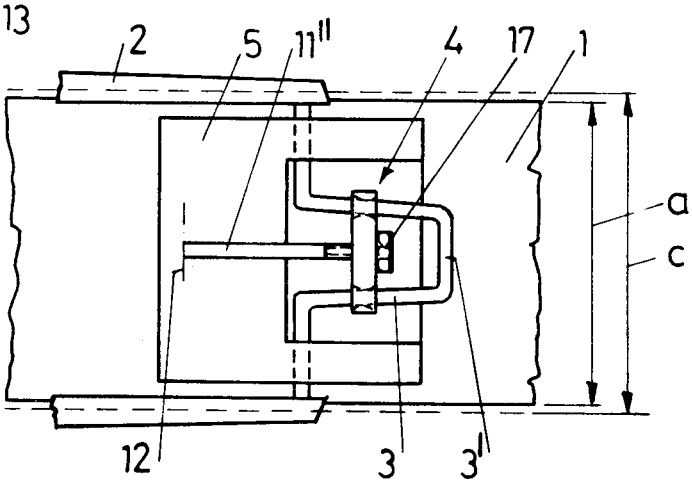

FIGS. 12 and 13 illustrate a further ski brake in the retracted position, which ski brake can be adjusted for various widths of skis (a and c). The two holding arms 3 are connected through a crossbar 3' and are prespring-tensioned in a position which diverges away from one another. The slide piece 4 is pivotally connected to the holding plate 5 through a lever 11''. The lever 11'' has at its end, which is opposite to the pivot bearing portion 12, a thread and a nut 17 threadedly engaged therewith. The nut 17 is positioned behind the slide piece 4 and determines its position, so that by rotating the nut 17 the spacing between the braking arms 2 in the retracted position is determined at the same time. The braking arms can, as this is illustrated in FIG. 13, be adjusted from the ski width a to the ski width c.

Figure 14:
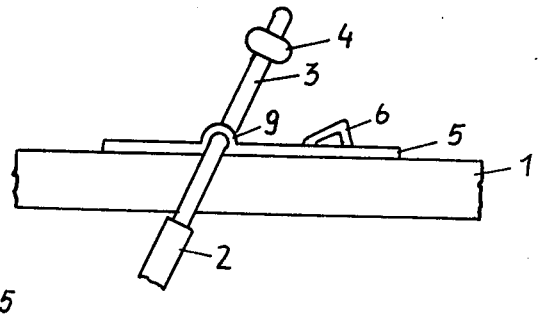
Figure 15:
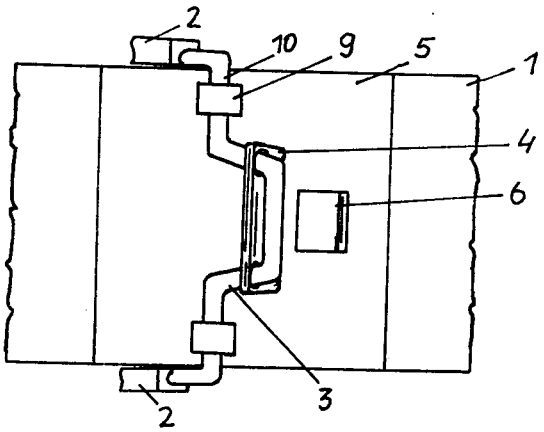
Figure 16:
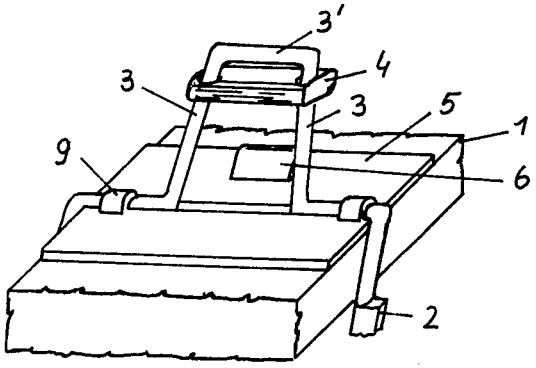

The exemplary embodiment which is illustrated in FIGS. 14 to 16 in the brake position uses also two holding arms 3 which are prespring-tensioned in a position which diverges away from a crossbar 3', and which are guided in a slide piece 4. The erecting power for the braking arms 2 can be produced in any desired manner. The bearing shafts 10 of the two braking arms 2 are received in base straps 9 struck out of the material of the holding plate 5 and can be moved axially therein. Furthermore, a slide 6 is constructed in the holding plate 5, which slide 6 moves the slide piece 4 when the holding arms 3 are stepped down upon by a ski boot and thus effects a pulling in of the braking arms only shortly prior to reaching the retracted or downhill position.

It can easily be seen that within the scope of the invention a plurality of exemplary embodiments are possible. For example, the holding arms or the braking arms can be pressed elastically inwardly, so that the slide piece 4 must only spread the holding arms apart.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A brake mechanism for use on skis, comprising:

a base plate mounted on a top surface of said ski;

a pair of laterally spaced brake members and bearing means supporting said brake members on said base plate for pivotal movement about a pivot axis and for movement toward and away from each other along said pivot axis, said brake members each having a braking arm and a holding arm, said brake members each being pivotal between an operative position wherein said braking arms project beneath a bottom surface of said ski and said holding arms project upwardly away from said top surface of said ski and an inoperative position wherein said braking arms are located above said top surface of said ski and said holding arms extend generally parallel to said top surface of said ski, said holding arms extend at an acute angle to each other when in said operative position;

a slide piece having a pair of laterally spaced openings therein each receiving one of said holding arms therethrough, the spacing between said openings corresponding to the lateral spacing between said holding arms at the ends thereof closest the apex of said acute angle and when said holding arms are in said operative position; and means for effecting a sliding of said slide piece along the length of said holding arms in response to a movement of said brake members between said operative and inoperative positions thereof, said slide piece effecting a movement of said brake members toward and away from each other simultaneous with said movement thereof along the length of said holding arms and, particularly, a movement of said braking arms toward each other to said location above said top surface of said ski when said brake members are in said inoperative position.

2. A brake mechanism according to claim 1, wherein said means for effecting a sliding of said slide piece includes a slide member secured to and extending between said base plate and said slide piece.

3. A brake mechanism according to claim 1, wherein said brake members are separate from each other and are connected through said slide piece, the ends of said holding arms remote from said braking arms having a greater lateral spacing than at the ends thereof adjacent said braking arms, said slide piece moving from said ends of said holding arms adjacent said braking arms toward said remote ends during a movement of said brake members from said operative position toward said inoperative position.

4. A brake mechanism according to claim 1, including resilient means for continually urging said brake members to said operative position.

5. A brake mechanism according to claim 1, wherein said brake members each have an axle segment extending parallel to said top surface of said ski and said pivot axis of which extends perpendicular to the longitudinal axis of said ski.

6. A brake mechanism according to claim 1, wherein said means for effecting a sliding of said slide piece includes a cam surface on said base plate operatively engaging said slide piece during a movement of said brake members between said operative and inoperative positions to effect said sliding movement of said slide piece.

7. A brake mechanism according to claim 1, wherein said means for effecting a sliding of said slide piece includes a lever pivotally secured to said base plate and said slide piece, and wherein said lever is elastically prespring-tensioned into the braking position.

8. A brake mechanism according to claim 1, wherein the ends of said holding arms are connected through a crossbar member for initially prespring tensioning said holding arms at least one of toward and away from one another.

9. A brake mechanism according to claim 8, wherein the ends of said holding arms remote from said braking arms and adjacent said crossbar member have a smaller lateral spacing than at the ends thereof adjacent said braking arms, said slide piece moving from said ends of said holding arms adjacent said crossbar member toward the ends adjacent said brake arms during a movement of said brake members from said operative position toward said inoperative position.

* * * * *